US007553003B2

(12) United States Patent
Takahashi et al.

(10) Patent No.: US 7,553,003 B2
(45) Date of Patent: Jun. 30, 2009

(54) LIQUID-JET HEAD AND LIQUID-JET APPARATUS

(75) Inventors: Tomoaki Takahashi, Nagano-ken (JP); Yoshinao Miyata, Nagano-ken (JP); Kazutoshi Goto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 515 days.

(21) Appl. No.: 11/502,350

(22) Filed: Aug. 11, 2006

(65) Prior Publication Data

US 2007/0035589 A1 Feb. 15, 2007

(30) Foreign Application Priority Data

Aug. 12, 2005 (JP) ..... 2005-234911

(51) Int. Cl.
*B41J 2/045* (2006.01)

(52) U.S. Cl. ..... 347/68

(58) Field of Classification Search ..... 347/68, 347/69–72, 5, 11; 400/124.16
See application file for complete search history.

(56) References Cited

U.S. PATENT DOCUMENTS

| | | | | |
|---|---|---|---|---|
| 2003/0019562 | A1 | 1/2003 | Warn | |
| 2006/0152556 | A1* | 7/2006 | Sugahara | 347/71 |
| 2006/0162481 | A1 | 7/2006 | Sato | |
| 2006/0187269 | A1* | 8/2006 | Takahashi | 347/68 |

FOREIGN PATENT DOCUMENTS

| | | | |
|---|---|---|---|
| CN | 1452853 | A | 10/2003 |
| CN | 1642742 | A | 7/2005 |
| JP | 2000-85122 | A | 3/2000 |
| JP | 2000-198208 | A | 7/2000 |
| JP | 2000-296616 | A | 10/2000 |
| JP | 2002-52723 | A | 2/2002 |
| JP | 2005-238762 | A | 9/2005 |

* cited by examiner

*Primary Examiner*—K. Feggins
(74) *Attorney, Agent, or Firm*—Sughrue Mion, PLLC

(57) ABSTRACT

A liquid-jet head, comprising: a nozzle plate having nozzle orifices bored therein; a passage-forming substrate provided with recesses including pressure generating chambers communicating with the nozzle orifices; piezoelectric elements provided on a surface of the passage-forming substrate via a vibration plate, each piezoelectric element including a lower electrode, a piezoelectric layer, and an upper electrode; and a joining plate joined to the surface of the passage-forming substrate, where the piezoelectric elements are formed, via an adhesive layer comprising an adhesive agent, wherein a plurality of contact portions and a joining portion are provided in a region where the joining plate is joined to the passage-forming substrate, the plurality of contact portions are protruded at a predetermined height on the vibration plate, and are substantially contacted by the joining plate, and the joining portion has the adhesive layer of a thickness equal to or larger than the height of the contact portions.

11 Claims, 6 Drawing Sheets

LIQUID-JET HEAD AND LIQUID-JET APPARATUS

The entire disclosure of Japanese Patent Application No. 2005-234911 filed Aug. 12, 2005 is expressly incorporated by reference herein.

BACKGROUND

1. Technical Field

The present invention relates to a liquid-jet head and a liquid-jet apparatus, and more particularly, an ink-jet recording head and an ink-jet recording apparatus in which a part of a pressure generating chamber communicating with a nozzle orifice for ejecting ink droplets is constructed from a vibration plate, a piezoelectric element is formed on the surface of the vibration plate, and ink droplets are ejected by displacement of the piezoelectric element.

2. Related Art

In an ink-jet recording head, a part of a pressure generating chamber communicating with a nozzle orifice for ejection of ink droplets is composed of a vibration plate, and the vibration plate is deformed by a piezoelectric element to pressurize ink in the pressure generating chamber, thereby ejecting ink droplets from the nozzle orifice. Two types of the ink-jet recording heads are put into practical use. One of them uses a piezoelectric actuator in the longitudinal vibration mode which expands and contracts in the axial direction of the piezoelectric element. The other uses a piezoelectric actuator in the flexural vibration mode.

An example of the ink-jet recording head using the piezoelectric actuator in the flexural vibration mode is one in which a nozzle plate having nozzle orifices bored therein is joined to a surface of a passage-forming substrate having pressure generating chambers formed therein, and a reservoir forming plate having a reservoir portion provided to constitute a reservoir for storing ink to be supplied to each pressure generating chamber is joined to the other surface of the passage-forming substrate (see, for example, JP-A-2000-296616 (Claims, FIG. 2, etc.)).

In such an ink-jet recording head, the respective members are generally formed from different materials. Thus, the linear expansion coefficients of the respective members are different, posing the problem that peeling or delamination occurs between the respective members according to changes in the environmental temperature. With the structure of JP-A-2000-296616, for example, the passage-forming substrate and the reservoir forming plate comprise silicon plates or substrates, and their linear expansion coefficients are about 2.0 [$\times 10^{-6}$/° C.], while the nozzle plate comprises stainless steel (SUS) and its linear expansion coefficient is 16 [$\times 10^{-6}$/° C.]. As seen from these facts, the linear expansion coefficient greatly differs between the members. Therefore, if the head is placed at a temperature lower than the temperature during adhesion of the passage-forming substrate and the nozzle plate, the nozzle plate shrinks relatively, thereby generating shear stress between the plates, leading to the problem that delamination occurs between the passage-forming substrate and the reservoir forming plate.

Metal layers, such as a lower electrode and an upper electrode, on an elastic film are formed at high temperatures during sputtering, vapor deposition or the like, and thus have initial stress even at room temperature. That is, shear stress is generated between the elastic film and each metal layer. In the structure provided with a lead electrode, which is described in JP-A-2000-296616, for example, the adhered surface (its uppermost portion) on the elastic film is a wiring metal layer comprising gold (Au). Since the adhesiveness between the wiring metal layer and the adhesive agent is insufficient, the risk of delamination is high. When the temperature changes, tensile stress and shear stress in the film thickness direction due to warpage of the entire chip occur, so that a longitudinally end portion of the chip is at the highest risk of delamination.

Such problems are not limited to the ink-jet recording head for ejection of ink, but are similarly present in other liquid-jet heads for ejecting liquid droplets other than ink.

SUMMARY

An advantage of some aspects of the present invention is to provide a liquid-jet head and a liquid-jet apparatus having a passage-forming substrate and a joining plate satisfactorily joined together, and capable of preventing delamination of the substrate and the plate.

According to an aspect of the invention, there is provided a liquid-jet head, comprising: a nozzle plate having nozzle orifices bored therein; a passage-forming substrate provided with recesses including pressure generating chambers communicating with the nozzle orifices; piezoelectric elements provided on a surface of the passage-forming substrate via a vibration plate, each piezoelectric element including a lower electrode, a piezoelectric layer, and an upper electrode; and a joining plate joined to the surface of the passage-forming substrate, where the piezoelectric elements are formed, via an adhesive layer comprising an adhesive agent, wherein a plurality of contact portions and a joining portion are provided in a region where the joining plate is joined to the passage-forming substrate, the plurality of contact portions are protruded at a predetermined height on the vibration plate, and are substantially contacted by the joining plate, and the joining portion has the adhesive layer of a thickness equal to or larger than the height of the contact portions.

According to this aspect, the passage-forming substrate and the joining plate are fixed while being positioned with high precision by the contact portions. In the joining portion, the thickness of the adhesive layer increases, so that shear stress decreases to prevent delamination between the passage-forming substrate and joining plate.

It is preferable that the joining portion be provided at least in an outer peripheral portion on a short side of the passage-forming substrate.

By so doing, the joining portion is provided in a predetermined region, so that delamination between the passage-forming substrate and joining plate can be suppressed efficiently.

It is also preferable that the joining portion be continuously formed in a peripheral edge portion of the passage-forming substrate on an entire periphery of the passage-forming substrate.

By so doing, delamination between the passage-forming substrate and joining plate can be suppressed efficiently.

It is also preferable that layers constituting the piezoelectric element not be formed in the joining portion.

Since the film which peels off relatively easily, such as the metal layer constituting the electrode of the piezoelectric element, is not provided in the joining portion, the strength of joining between the passage-forming substrate and joining plate further increases.

It is also preferable that in at least a part of the joining portion, the surface of the passage-forming substrate be exposed.

Since the joining plate is directly joined to the surface of the passage-forming substrate, joining strength between the passage-forming substrate and joining plate further increases.

It is also preferable that in a region of a surface of joining of the joining plate to the passage-forming substrate, which is opposite the joining portion, a surface of the joining plate be exposed.

Since the passage-forming substrate is directly joined to the surface of the joining plate, joining strength between the passage-forming substrate and joining plate further increases.

It is also preferable that the joining portion be provided in a region of the passage-forming substrate where the recesses are not formed.

By so doing, cracks can be prevented from occurring in the vibration plate in the region opposite the joining portion.

It is also preferable that the contact portions be formed by layers constituting the piezoelectric element.

The use of the films constituting the piezoelectric element makes it possible to form the contact portions relatively easily without increasing cost.

It is also preferable that the contact portion be continuously provided at least in the vicinity of an end of the passage-forming substrate along the end on an entire periphery of the passage-forming substrate, and the joining portion be provided inwardly of the contact portion.

By so doing, when the joining plate and the passage-forming substrate are joined, they are reliably supported by the contact portion, and they are not secured to each other in an inclined state.

It is also preferable that in a region which is at least a part of the region where the joining plate is joined to the passage-forming substrate, a plurality of the contact portions be provided independently of each other and each in a shape of an island, and the joining portion be continuously provided around the plurality of the contact portions.

By so doing, even when the joining portion is provided in a relatively wide region, the joining plate is supported by the island-shaped contact portions, whereby warping of the joining plate itself is prevented. Since the adhesive agent flows satisfactorily into the joining portion, moreover, the passage-forming substrate and the joining plate are joined together more satisfactorily.

According to another aspect of the invention, there is provided a liquid-jet apparatus including the above liquid-jet head.

According to this aspect, a liquid-jet apparatus markedly increased in the durability of the head and improved in reliability can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

The present invention will now be described in detail based on the embodiments offered below.

Embodiment 1

Figure 1:
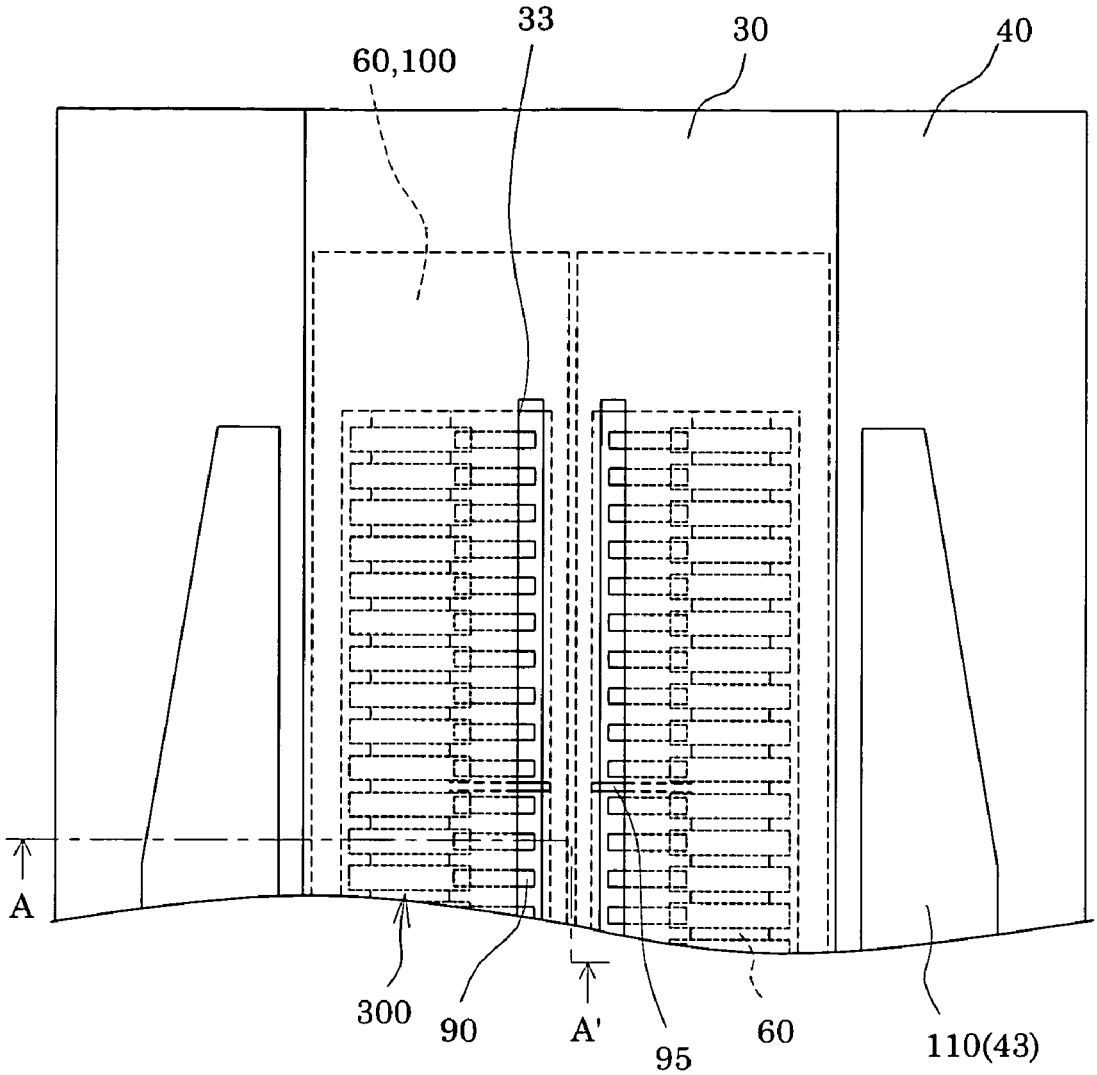
FIG. 1 is a plan view of a recording head according to Embodiment 1 of the present invention.
Figure 2:
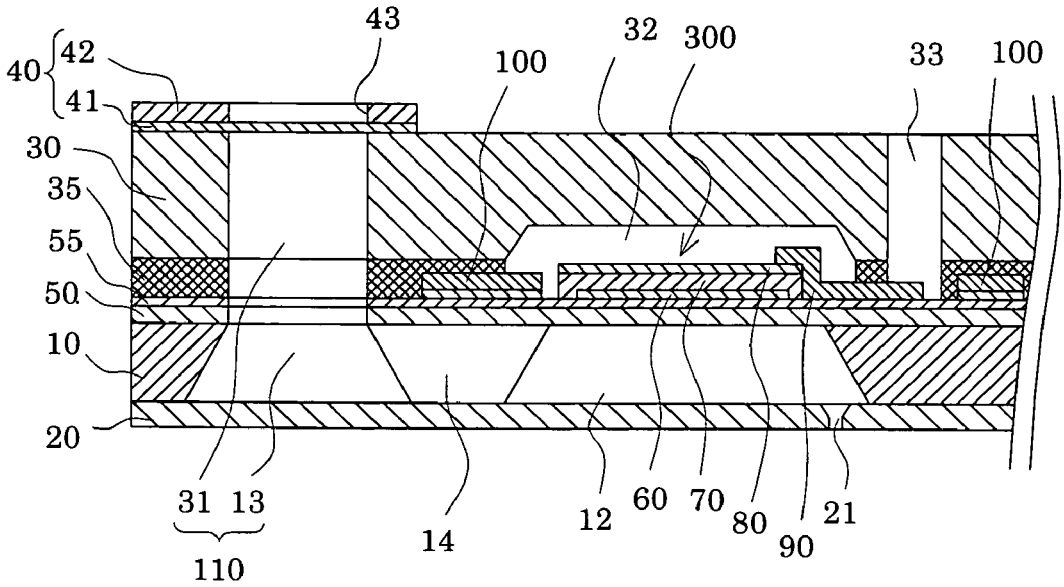
FIG. 2 is a sectional view of the recording head according to Embodiment 1.

FIG. 1 is a plan view of an ink-jet recording head according to Embodiment 1 of the present invention. FIG. 2 is a sectional view taken on line A-A' of FIG. 1. A passage-forming substrate 10 consists of a single crystal silicon substrate having a plane (110) of the plane orientation. As shown here, an elastic film 50 comprising silicon dioxide and having a thickness of 0.5 to 2 μm is formed on one surface of the passage-forming substrate 10. In the passage-forming substrate 10, a plurality of pressure generating chambers 12 are disposed parallel in the width direction of the passage-forming substrate 10 to form a row of the pressure generating chambers 12, and two of the rows are provided. A communicating portion 13 is formed outwardly of each row of the pressure generating chambers 12 in the passage-forming substrate 10. The communicating portion 13 and each of the pressure generating chambers 12 are brought into communication via an ink supply path 14 formed in a smaller width than that of the pressure generating chamber 12. The communicating portion 13 communicates with a reservoir portion of a reservoir forming plate (to be described later) to constitute a reservoir serving as a common ink chamber for the respective pressure generating chambers 12. The ink supply path 14 keeps constant the passage resistance of ink flowing from the communicating portion 13 into the pressure generating chamber 12.

On a surface of the passage-forming substrate 10 which is opposite the elastic film 50, a nozzle plate 20 having nozzle orifices 21 bored therein is secured by an adhesive agent or a heat sealing film. Each of the nozzle orifices 21 communicates with the vicinity of the end of the pressure generating chamber 12 on the side opposite the ink supply path 14. The nozzle plate 20 comprises a glass ceramic, a single crystal silicon substrate, or stainless steel, and has a thickness, for example, of 0.01 to 1 mm and a linear expansion coefficient, for example, of 2.5 to 20 [$\times 10^{-6}$/° C.] at 300° C. or lower. In the present embodiment, for example, the nozzle plate 20 is formed from stainless steel (SUS), and its linear expansion coefficient is of the order of 16 [$\times 10^{-6}$/° C.].

On the surface of the passage-forming substrate 10 opposite its opening surface, the elastic film 50 having a thickness, for example, of about 1.0 μm is formed, as described above. An insulation film 55 comprising zirconium oxide ($ZrO_2$) and having a thickness, for example, of about 0.4 μm is formed on the elastic film 50. On the insulation film 55, a lower electrode film 60 comprising platinum (Pt) and iridium (Ir) and having a thickness, for example, of about 0.2 μm, a piezoelectric layer 70 comprising lead zirconate titanate (PZT) and having a thickness, for example, of about 1.0 μm, and an upper electrode film 80 comprising iridium (Ir) and having a thickness, for example, of about 0.05 μm are formed by lamination according to a process (to be described later) to constitute a piezoelectric element 300.

The material for the piezoelectric layer 70 may be, for example, a relaxor ferroelectric having a metal, such as niobium, nickel, magnesium, bismuth or yttrium, added to a ferroelectric piezoelectric material such as lead zirconate titanate (PZT). The composition of the piezoelectric layer 70 may be chosen, as appropriate, in consideration of the characteristics, uses, etc. of the piezoelectric element. Its examples are $PbTiO_3$ (PT), $PbZrO_3$ (PZ), $Pb(Zr_xTi_{1-x})O_3$ (PZT), $Pb(Mg_{1/3}Nb_{2/3})O_3$—$PbTiO_3$ (PMN-PT), $Pb(Zn_{1/3}Nb_{2/3})O_3$—$PbTiO_3$ (PZN-PT), $Pb(Ni_{1/3}Nb_{2/3})O_3$—$PbTiO_3$ (PNN-PT), Pb $(In_{1/2}Nb_{1/2})O_3$—$PbTiO_3$ (PIN-PT), $Pb(Sc_{1/3}Ta_{2/3})O_3$—$PbTiO_3$ (PST-PT), Pb $(Sc_{1/3}Nb_{2/3})O_3$—$PbTiO_3$ (PSN-PT), $BiScO_3$—$PbTiO_3$ (BS-PT), and $BiYbO_3$—$PbTiO_3$ (BY-PT).

The piezoelectric element 300 refers to a portion including the lower electrode film 60, the piezoelectric layer 70, and the upper electrode film 80. Generally, one of the electrodes of the piezoelectric element 300 is used as a common electrode, and the other electrode and the piezoelectric layer 70 are constructed for each pressure generating chamber 12 by patterning. In the present embodiment, the lower electrode film 60 is used as the common electrode for the piezoelectric elements 300, while the upper electrode film 80 is used as an individual electrode of each piezoelectric element 300. However, there is no harm in reversing their usages to accommodate a drive circuit or wiring. A lead electrode 90 for the upper electrode (hereinafter called the upper electrode lead electrode 90) is connected to each upper electrode film 80 which is the individual electrode of the piezoelectric element 300. Voltage is applied to each piezoelectric element 300 via the upper electrode lead electrode 90.

In the present embodiment, the lower electrode film 60, which is the common electrode of the piezoelectric element 300, is formed in a region opposite the pressure generating chamber 12 in the longitudinal direction of the pressure generating chamber 12, and is formed continuously throughout a region corresponding to the plurality of pressure generating chambers 12 in the parallel arrangement direction of the pressure generating chambers 12. Also, the lower electrode film 60 extends to the outside of the row of the pressure generating chambers 12 in the parallel arrangement direction of the pressure generating chambers 12 and, in the present embodiment, is formed continuously around the plurality of piezoelectric elements 300 and upper electrode lead electrodes 90 arranged parallel. The lower electrode film 60 in this configuration is formed for each row of the pressure generating chambers 12. The piezoelectric layer 70 and the upper electrode film 80, which constitute the piezoelectric element 300, are basically provided in the region opposite the pressure generating chamber 12, but in the longitudinal direction of the pressure generating chamber 12, they extend to the outside of the end of the lower electrode film 60.

A layer different from the lower electrode film 60 and the upper electrode film 80, in the present embodiment, a laminated electrode 100 comprising the same layer as the upper electrode lead electrode 90, is provided outwardly of the region corresponding to the parallel arranged pressure generating chambers 12. The laminated electrode 100 is electrically connected to the lower electrode film 60. A lead electrode 95 for the lower electrode (hereinafter called the lower electrode lead electrode 95) continuous with the laminated electrode 100 is provided in a region between the parallel arranged piezoelectric elements 300 at a rate, for example, of about one lower electrode lead electrode 95 for ten of the piezoelectric elements 300. The lower electrode lead electrode 95 is constituted of the same layer as the upper electrode lead electrode 90.

A reservoir forming plate 30, which has a reservoir portion 31 in a region corresponding to the communicating portion 13 of the passage-forming substrate 10, is joined to a surface of the passage-forming substrate 10 where the piezoelectric elements 300 are formed. In the present embodiment, the reservoir portion 31 penetrates the reservoir forming plate 30 in its thickness direction, and is formed along the parallel arrangement direction of the pressure generating chambers 12. As mentioned above, the reservoir portion 31 communicates with the communicating portion 13 of the passage-forming substrate 10 to constitute a reservoir 110 which serves as a common ink chamber for the respective pressure generating chambers 12. In the reservoir forming plate 30, a piezoelectric element holding portion 32, which can ensure a space where the movement of the piezoelectric elements 300 is not impeded is provided in a region opposite the piezoelectric elements 300. Since the piezoelectric elements 300 are formed within the piezoelectric element holding portion 32, the piezoelectric elements 300 are protected in a state practically free from the influence of the external environment. The piezoelectric element holding portion 32 may be sealed or unsealed.

An exposure hole 33, which penetrates the reservoir forming plate 30 and exposes the upper electrode lead electrodes 90, etc., is formed in a middle region of the reservoir forming plate 30, namely, in a region on the opposite side of the piezoelectric element holding portion 32 from the reservoir portion 31. A drive IC mounted on the reservoir forming plate 30, the upper electrode lead electrode 90, and the lower electrode film 60 are electrically connected by connection wiring extending into the exposure hole 33, although this is not illustrated.

The material for the reservoir forming plate 30 is, for example, glass, ceramic material, metal or resin. More preferably, the reservoir forming plate 30 is formed from a material having nearly the same thermal expansion coefficient as that of the passage-forming substrate 10 and, in the present embodiment, is formed using a single crystal silicon substrate which is the same material as that used for the passage-forming substrate 10.

Figure 3:
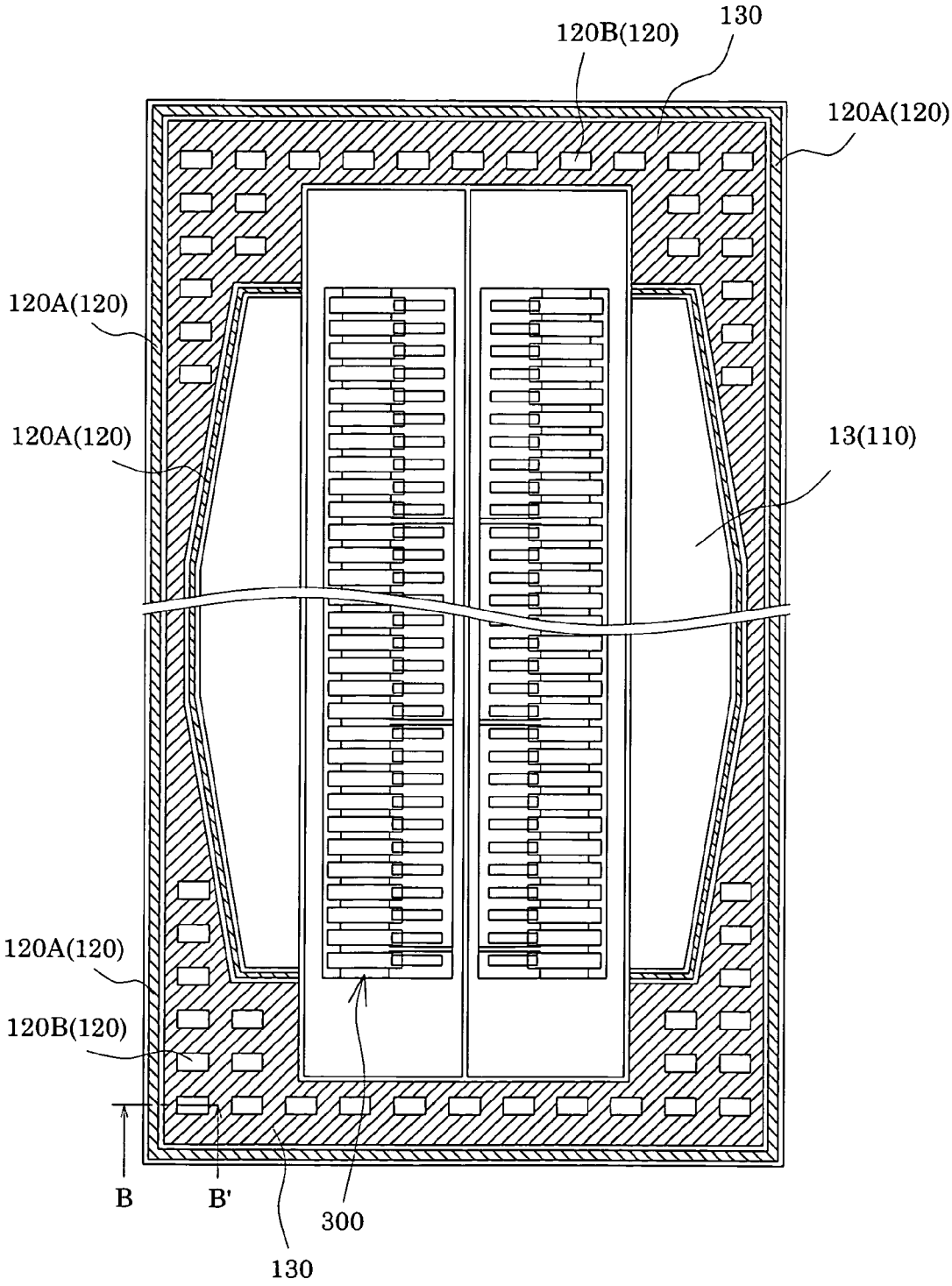
FIG. 3 is a plan view showing the arrangement of contact portions and a joining portion on a passage-forming substrate.

The reservoir forming plate 30 is joined to the passage-forming substrate 10 by an adhesive layer 35 comprising, for example, an epoxy-based adhesive agent. In the present invention, as shown in FIG. 3 and later, a plurality of contact portions 120, which protrude at a nearly constant height on the passage-forming substrate 10 and with which the reservoir forming plate 30 is substantially brought into contact, are provided in a region where the reservoir forming plate 30 is joined to the passage-forming substrate 10. Also, a joining portion 130 where the adhesive layer 35 is formed in a thickness equal to or greater than the height of the contact portion 120 is provided in the region where the reservoir forming plate 30 is joined to the passage-forming substrate 10. The reservoir forming plate 30 is positioned in substantial contact with the contact portions 120 and, in this state, is secured onto the passage-forming substrate 10 by the adhesive layer 35 of a predetermined thickness in the joining portion 130. The adhesive layer 35 is present between the contact portion 120 and the reservoir forming plate 30, and its film thickness is as small as, for example, of the order of 0.1 to 1 μm, and of the order of 0.5 μm in the present embodiment. As a result, the reservoir forming plate 30 is substantially in contact with the contact portions 120.

The foregoing configuration produces the effects that the passage-forming substrate 10 and the reservoir forming plate 30 can be joined satisfactorily, and their delamination can be prevented, although details will be offered later.

Figure 4:
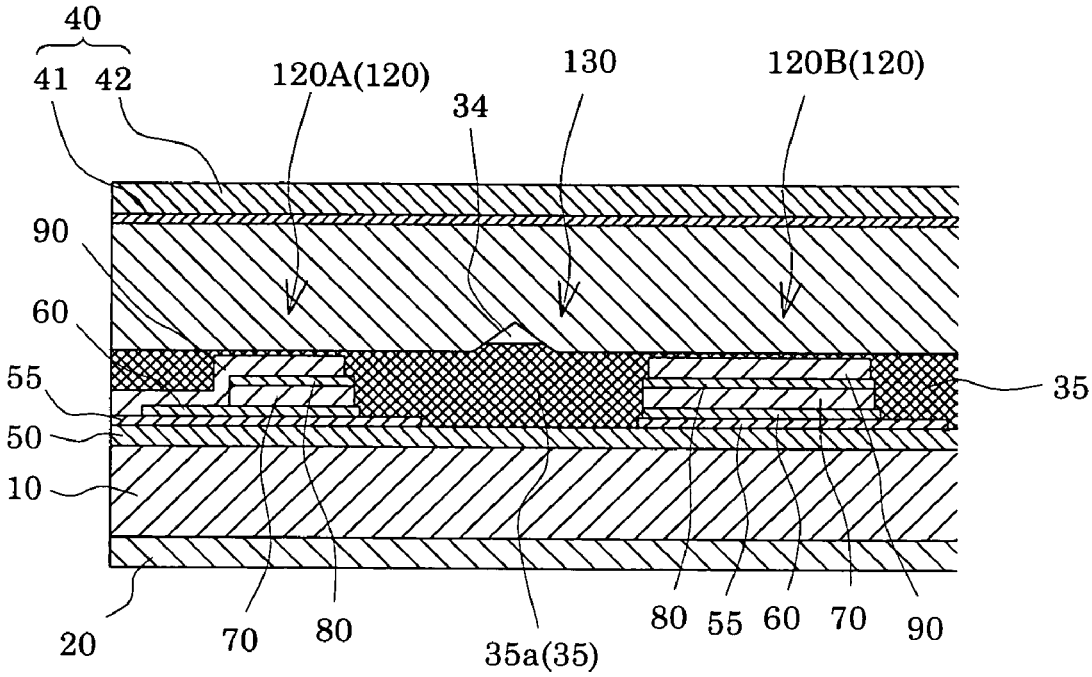
FIG. 4 is a sectional view showing essential parts of the recording head according to Embodiment 1.

In the present embodiment, a band-shaped contact portion 120A is continuously provided in the vicinity of the end of the passage-forming substrate 10 over the entire periphery of the passage-forming substrate 10. The band-shaped contact portion 120A is also continuously provided around the reservoir 110, except the region opposite the ink supply paths 14. In the present embodiment, moreover, a plurality of island-shaped contact portions 120B, which are independent of each other, are disposed with predetermined spacing in the region defined between the band-shaped contact portions 120A. As shown in the sectional view, as FIG. 4, taken on line B-B' in FIG. 3, the contact portion 120 is composed of the layers constituting the piezoelectric element 300, namely, the lower electrode film 60, the piezoelectric layer 70, the upper electrode film 80, and the upper electrode lead electrode 90 laminated on the insulation film 55. In this manner, the contact portion 120 can be fabricated, simultaneously with the piezoelectric element 300 formed in the region opposite the pressure generating chamber 12, with the use of the layers constituting the piezoelectric element 300. Thus, the contact portion 120 can be easily formed without cost increase. The respective layers constituting the contact portion 120 are discontinuous with the piezoelectric element 300.

On the other hand, the joining portion 130, in the present embodiment, is provided in a region inward of the band-shaped contact portion 120A, as shown in FIG. 3. Specifically, the region between the contact portion 120A provided in the vicinity of the end of the passage-forming substrate 10 and the band-shaped contact portion 120A provided around the reservoir 110 defines the joining portion 130, which is continuously provided on the entire periphery of the passage-forming substrate 10. In the present embodiment, the island-shaped contact portions 120B are dotted in the joining portion 130. The joining portion 130 needs to have the adhesive layer 35*a* formed in a thickness equal to or greater than the height of the contact portion 120, as stated earlier, but another film structure of the joining portion 130 is not restricted. However, the respective layers, i.e., the lower electrode film 60, the piezoelectric layer 70, the upper electrode film 80, and the upper electrode lead electrode 90, undergo delamination relatively easily. Thus, these layers, preferably, are not formed in the joining portion 130. Furthermore, in the joining portion 130, the surface of the passage-forming substrate 10 is preferably exposed. In the present embodiment, the insulation film 55 in the region corresponding to the joining portion 130 is removed to expose the surface of the passage-forming substrate 10 (elastic film 50) (see FIG. 4). The elastic film 50, in the present embodiment, is integrally formed by thermally oxidizing the single crystal silicon substrate which is the passage-forming substrate 10, so that the surface of the elastic film 50 is substantially the surface of the passage-forming substrate 10.

The reservoir forming plate 30 joined via the adhesive layer 35 onto the passage-forming substrate 10 provided with the contact portions 120 and the joining portion 130 can be secured satisfactorily to the passage-forming substrate 10, and its peeling due to changes in the environmental temperature is also prevented. Specifically, the reservoir forming plate 30 is brought into contact with the contact portion 120 on the passage-forming substrate 10, whereby the passage-forming substrate 10 and the reservoir forming plate 30 are positioned. Thus, both can be bonded always under constant conditions. In the present embodiment, moreover, the plurality of island-shaped contact portions 120B are provided. Thus, when the passage-forming substrate 10 and the reservoir forming plate 30 are joined, the adhesive agent in the portion corresponding to the contact portion 120B flows into the joining portion 130, and the adhesive agent is filled satisfactorily. As a result, a satisfactory adhesive layer 35 with few bubbles incorporated is formed. Hence, the passage-forming substrate 10 and the reservoir forming plate 30 are secured satisfactorily. In the present embodiment, a relief groove 34, which is a space where a surplus adhesive agent flows in, is provided in a region of the reservoir forming plate 30 corresponding to the joining portion 130. Thus, even if the amount of the adhesive agent coated is too large in joining the passage-forming substrate 10 and the reservoir forming plate 30, both can be joined satisfactorily.

Furthermore, a relatively large thickness can be ensured as the thickness of the adhesive layer 35*a* of the joining portion 130. This decreases shear stress generated owing to the difference in linear expansion coefficient between the nozzle plate 20 and the passage-forming substrate 10. Thus, delamination can be prevented from occurring between the passage-forming substrate 10 and the reservoir forming plate 30. Specifically, the thickness of the adhesive layer 35*a* of the joining portion 130 is preferably of the order of 1.5 to 5 μm, for example in the configuration of the present embodiment, about 3 μm.

According to the present embodiment, moreover, the insulation film 55 in the region corresponding to the joining portion 130 is removed to expose the surface of the passage-forming substrate 10. Thus, the above-mentioned delamination can be prevented more reliably. Specifically, the reservoir forming plate 30 is not bonded to the film formed on the passage-forming substrate 10, but is directly bonded to the passage-forming substrate 10 itself. Thus, the reservoir forming plate 30 and the passage-forming substrate 10 are joined more firmly. In the present embodiment, the insulation film 55 in the region corresponding to the joining portion 130 is removed to expose the surface of the elastic film 50. However, it goes without saying that not only the insulation film 55 but also the elastic film 50 may be removed. In the region corresponding to the joining portion 130, moreover, it is desirable that the surface of the reservoir forming plate 30 be also exposed, as is the passage-forming substrate 10.

Besides, in the present embodiment, the band-shaped contact portion 120A is provided near the end of the passage-forming substrate 10 on the entire periphery of the passage-forming substrate 10, and the island-shaped contact portions 120B are dotted. Thus, the distance between the passage-forming substrate 10 and the reservoir forming plate 30 is nearly constant overall. That is, the thickness of the adhesive layer 35*a* in the joining portion 130 is nearly constant overall. Hence, the passage-forming substrate 10 and the reservoir forming plate 30 are joined overall under more uniform conditions, and their adhesion strength is further increased.

Figure 5:
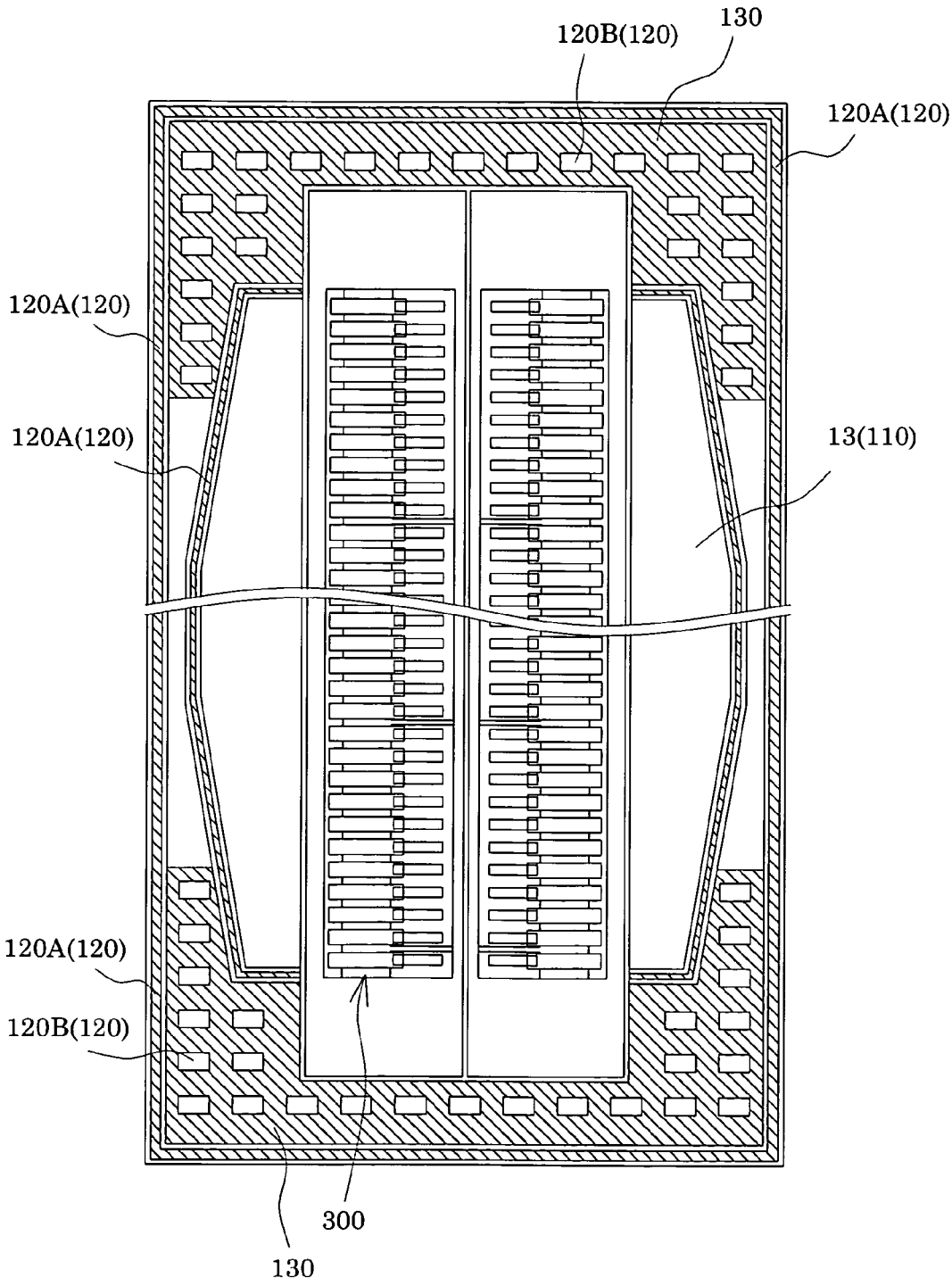
FIG. 5 is a plan view showing a modification of the recording head according to Embodiment 1.

In the present embodiment, the contact portion 120 and the joining portion 130 are provided throughout the outer peripheral portion of the passage-forming substrate 10. However, the arrangement of the contact portions 120 and the joining portions 130 is not limited. For example, as shown in FIG. 5, the joining portions 130 may be provided, without being rendered continuous, in longitudinally opposite end portions of the passage-forming substrate 10. It suffices that the contact portion 120 and the joining portion 130 are provided, at least, in a portion particularly susceptible to delamination, such as the outer peripheral portion on the short side of the passage-forming substrate 10. However, it is desirable for the joining portion 130 not to be provided in the region where a recess penetrating the passage-forming substrate 10, such as the pressure generating chamber 12 or the communicating portion 13, is formed. This is because cracks may be produced in the elastic film 50 or the like in the portion corresponding to the recess, if the aforementioned shear stress occurs.

A compliance plate 40, which consists of a sealing film 41 and a fixing plate 42, is joined onto the reservoir forming plate 30 (see FIG. 2). The sealing film 41 comprises a low rigidity, flexible material (for example, a polyphenylene sulfide (PPS)

film of 6 μm in thickness), and the sealing film 41 seals one surface of the reservoir portion 31. The fixing plate 42 is formed from a hard material such as a metal (for example, stainless steel (SUS) of 30 μm in thickness). A region of the fixing plate 42 opposite the reservoir 110 defines an opening portion 43 completely deprived of the plate in the thickness direction. Thus, one surface of the reservoir 110 is sealed only with the sealing film 41 having flexibility.

With the ink-jet recording head of the present embodiment described above, ink is taken in from an external ink supply unit (not shown), and the interior of the head ranging from the reservoir 110 to the nozzle orifices 21 is filled with the ink. Then, according to recording signals from the drive IC (not shown) mounted on the reservoir forming plate 30, voltage is applied between the lower electrode film 60 and the upper electrode film 80 corresponding to the pressure generating chamber 12 to flexibly deform the elastic film 50, the insulation film 55, the lower electrode film 60 and the piezoelectric layer 70. As a result, the pressure inside each pressure generating chamber 12 rises to eject ink droplets through the nozzle orifice 21.

Other Embodiments

An embodiment of the present invention has been described but, but the invention is not limited this embodiment. The above embodiment, for example, describes an example in which the plurality of island-shaped contact portions 120B are provided along with the band-shaped contact portions 120A. However, it goes without saying that only the band-shaped contact portions 120A may be provided, or only the island-shaped contact portions 120B may be provided. Moreover, the above embodiment, for example, illustrates the reservoir forming plate 30 having the reservoir portion 31 as the joining plate. However, the joining plate is not limited to the reservoir forming plate, but may be any plate, if it is a plate joined to the passage-forming substrate.

Figure 6:
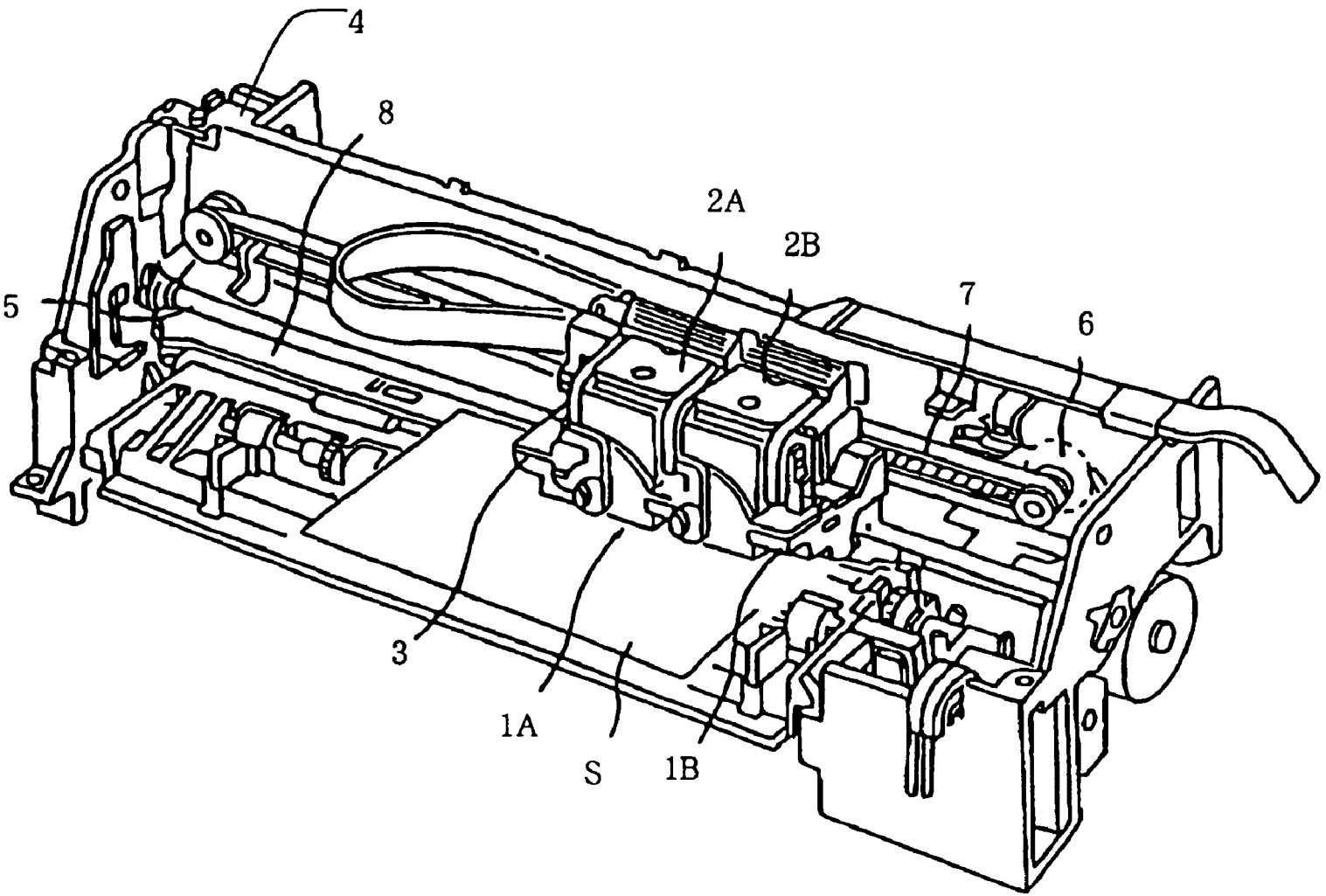
FIG. 6 is a schematic view of a recording apparatus according to an embodiment of the invention.

The ink-jet recording head of the above-mentioned embodiments is then mounted on an ink-jet recording apparatus as a part of a recording head unit having ink passages communicating with an ink cartridge, etc. FIG. 6 is a schematic view showing an example of this ink-jet recording apparatus. As shown in FIG. 6, cartridges 2A and 2B constituting ink supply units are detachably provided in recording head units 1A and 1B having the ink-jet recording heads, and a carriage 3 bearing the recording head units 1A and 1B is provided axially movably on a carriage shaft 5 mounted on an apparatus body 4. The recording head units 1A and 1B are to eject, for example, a black ink composition and a color ink composition, respectively. The drive force of a drive motor 6 is transmitted to the carriage 3 via a plurality of gears (not shown) and a timing belt 7, whereby the carriage 3 bearing the recording head units 1A and 1B is moved along the carriage shaft 5. The apparatus body 4 is provided with a platen 8 along the carriage shaft 5, and a recording sheet S as a recording medium, such as paper, which has been fed by a sheet feed roller or the like (not shown), is transported on the platen 8.

In the above-described embodiment, the ink-jet recording head is taken for illustration as an example of the liquid-jet head according to the invention. However, the basic configuration of the liquid-jet head is not limited to what has been described above. The invention widely targets liquid-jet heads in general and, needless to say, can be applied to liquid-jet heads for jetting liquids other than ink. Other liquid-jet heads include, for example, various recording heads for use in image recording devices such as printers, color material jet heads for use in the production of color filters such as liquid crystal displays, electrode material jet heads for use in the formation of electrodes for organic EL displays and FED (face emitting displays), and bio-organic material jet heads for use in the production of biochips. It should be understood that such changes, substitutions and alterations can be made therein without departing from the spirit and scope of the invention as defined by the appended claims.

What is claimed is:

1. A liquid-jet head, comprising:

a nozzle plate having nozzle orifices bored therein;

a passage-forming substrate provided with recesses including pressure generating chambers communicating with the nozzle orifices;

piezoelectric elements provided on a surface of the passage-forming substrate via a vibration plate, each piezoelectric element including a lower electrode, a piezoelectric layer, and an upper electrode; and a joining plate joined to the surface of the passage-forming substrate, where the piezoelectric elements are formed, via an adhesive layer comprising an adhesive agent, wherein a plurality of contact portions and a joining portion are provided in a region where the joining plate is joined to the passage-forming substrate of the passage-forming substrate to the joining plate, the plurality of contact portions are protruded at a predetermined height on the vibration plate, and are substantially contacted by the joining plate, and the joining portion has the adhesive layer of a thickness equal to or larger than the height of the contact portions.

2. The liquid-jet head according to claim 1, wherein the joining portion is provided at least in an outer peripheral portion on a short side of the passage-forming substrate.

3. The liquid-jet head according to claim 1, wherein the joining portion is continuously formed in a peripheral edge portion of the passage-forming substrate on an entire periphery of the passage-forming substrate.

4. The liquid-jet head according to claim 1, wherein layers constituting the piezoelectric element are not formed in the joining portion.

5. The liquid-jet head according to claim 1, wherein in at least a part of the joining portion, the surface of the passage-forming substrate is exposed.

6. The liquid-jet head according to claim 1, wherein in a region of a surface of joining of the joining plate to the passage-forming substrate, which is opposite the joining portion, a surface of the joining plate is exposed.

7. The liquid-jet head according to claim 1, wherein the joining portion is provided in a region of the passage-forming substrate where the recesses are not formed.

8. The liquid-jet head according to claim 1, wherein the contact portions are formed by layers constituting the piezoelectric element.

9. The liquid-jet head according to claim 1, wherein the contact portion is continuously provided at least in the vicinity of an end of the passage-forming substrate along the end on an entire periphery of the passage-forming substrate, and the joining portion is provided inwardly of the contact portion.

10. The liquid-jet head according to claim 1, wherein in a region which is at least a part of the region where the joining plate is joined to the passage-forming substrate, a plurality of the contact portions are provided independently of each other and each in a shape of an island, and the joining portion is continuously provided around the plurality of the contact portions.

11. A liquid-jet apparatus including the liquid-jet head according to claim 1.

* * * * *